US007928916B2

(12) United States Patent
Hung et al.

(10) Patent No.: US 7,928,916 B2
(45) Date of Patent: Apr. 19, 2011

(54) MULTI-BAND ANTENNA

(75) Inventors: Chen-Ta Hung, Tu-cheng (TW); Shang-Jen Chen, Tu-cheng (TW); Chun-Ming Chiu, Tu-cheng (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 350 days.

(21) Appl. No.: 12/290,078

(22) Filed: Oct. 27, 2008

(65) Prior Publication Data

US 2009/0109098 A1 Apr. 30, 2009

(30) Foreign Application Priority Data

Oct. 26, 2007 (TW) ..... 96140331 A

(51) Int. Cl.
*H01Q 1/24* (2006.01)
*H01Q 1/38* (2006.01)

(52) U.S. Cl. ..... 343/702; 343/700 MS; 343/846

(58) Field of Classification Search ..... 343/702, 343/700 MS, 846
See application file for complete search history.

(56) References Cited

U.S. PATENT DOCUMENTS

| | | | | |
|---|---|---|---|---|
| 7,289,071 | B2 * | 10/2007 | Hung et al. | 343/702 |
| 7,525,490 | B2 * | 4/2009 | Hung et al. | 343/702 |
| 7,642,967 | B2 * | 1/2010 | Wang et al. | 343/702 |
| 2007/0040754 | A1 | 2/2007 | Liu et al. | |
| 2007/0060222 | A1 | 3/2007 | Finn et al. | |
| 2007/0096999 | A1 | 5/2007 | Wang et al. | |

* cited by examiner

*Primary Examiner* — Hoang V Nguyen
(74) *Attorney, Agent, or Firm* — Wei Te Chung; Andrew C. Cheng; Ming Chieh Chang

(57) ABSTRACT

A multi-band antenna includes a grounding element, a connecting element extending from one end of the grounding element, a first conductive portion extending from the connecting element, a second conductive portion extending from the first conductive portion and narrower than the first conductive portion, a first coupling portion extending from the connecting element in a first direction, a second coupling portion extending from the other end of the grounding element and opposite to the connecting element. The second coupling portion extending in a second direction opposite to the first direction and overlap the first coupling portion.

17 Claims, 3 Drawing Sheets

MULTI-BAND ANTENNA

BACKGROUND OF THE INVENTION

1. Field of the Invention

The present invention relates generally to a multi-band antenna, and more particularly to a multi-band antenna suitable for being built into an electronic device, such as a notebook.

2. Description of the Prior Art

A present electric device always needs more than one type of antennas for wireless communication. To make design of the electric device more beautiful, theses antennas are assembled in the inner space of the electric device. Thus, antennas used on different frequency bands are always integrated together to reduce their volume for the limited inner space.

US Patent Application Publication No. 2007/0040754 discloses an antenna structure integrating a first antenna of wireless wide area network (WWAN) and a second antenna of wireless local area network (WLAN), the same as U.S. Pat. No. 7,289,071, US Patent Application Publication No. 2007/0060222, US Patent Application Publication No. 2007/0096999, and so on. The first and second antennas respectively work as a single antenna but not influence to each other. However, the antenna structure has two feeding line to support the two separated antennas, so that the structure is complex.

Hence, in this art, a multi-band antenna to overcome the above-mentioned disadvantages of the prior art should be provided.

BRIEF SUMMARY OF THE INVENTION

A primary object, therefore, of the present invention is to provide a multi-band antenna with simple structure and used in different wireless communication criterions.

In order to implement the above object, the multi-band antenna comprises a grounding element, a connecting element extending from one end of the grounding element, a first conductive portion extending from the connecting element, a second conductive portion extending from the first conductive portion and narrower than the first conductive portion, a first coupling portion extending from the connecting element in a first direction, a second coupling portion extending from the other end of the grounding element and opposite to the connecting element. The second coupling portion extending in a second direction opposite to the first direction and overlap the first coupling portion.

Other objects, advantages and novel features of the invention will become more apparent from the following detailed description of a preferred embodiment when taken in conjunction with the accompanying drawings.

DETAILED DESCRIPTION OF THE INVENTION

Reference will now be made in detail to a preferred embodiment of the present invention.

Figure 1:
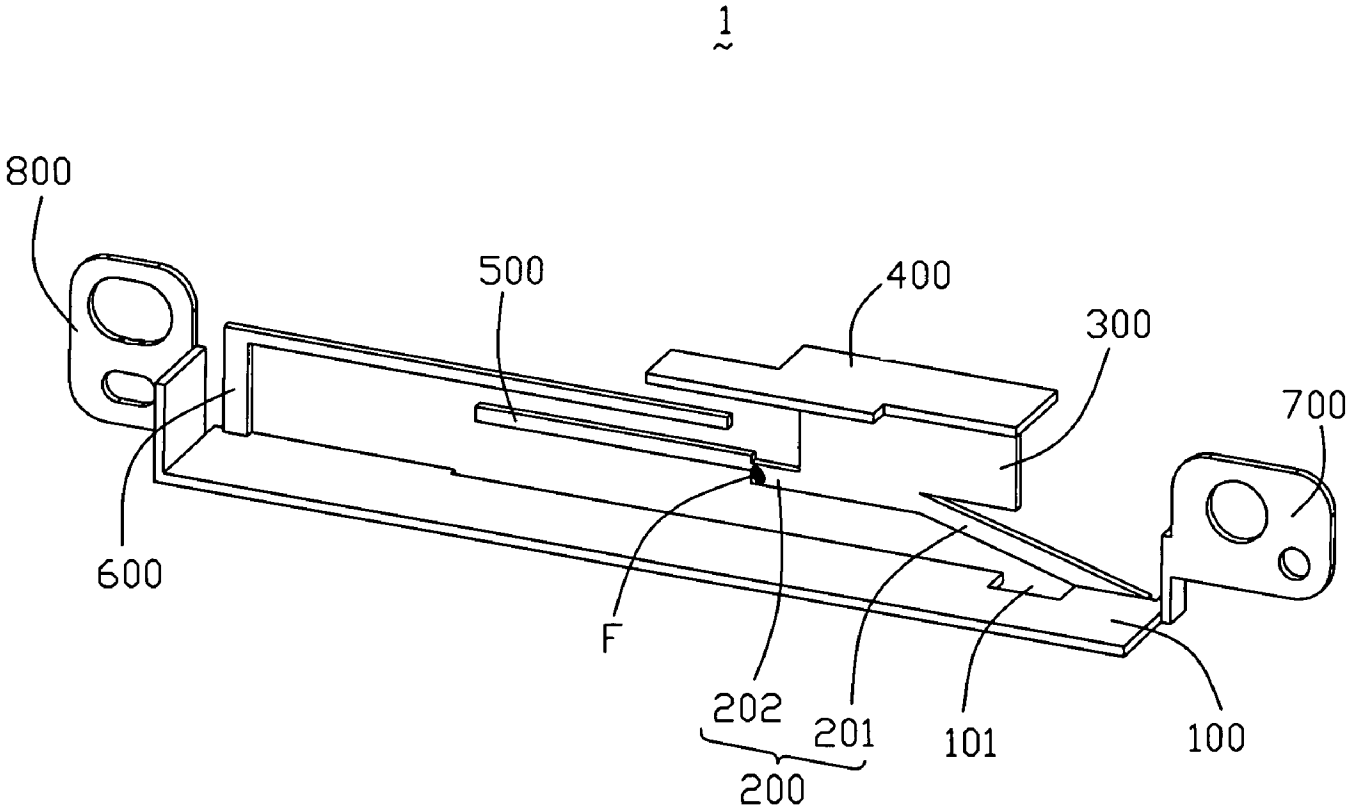
FIG. 1 is a perspective view illustrating a first embodiment of a multi-band antenna in according with the present invention.
Figure 2:
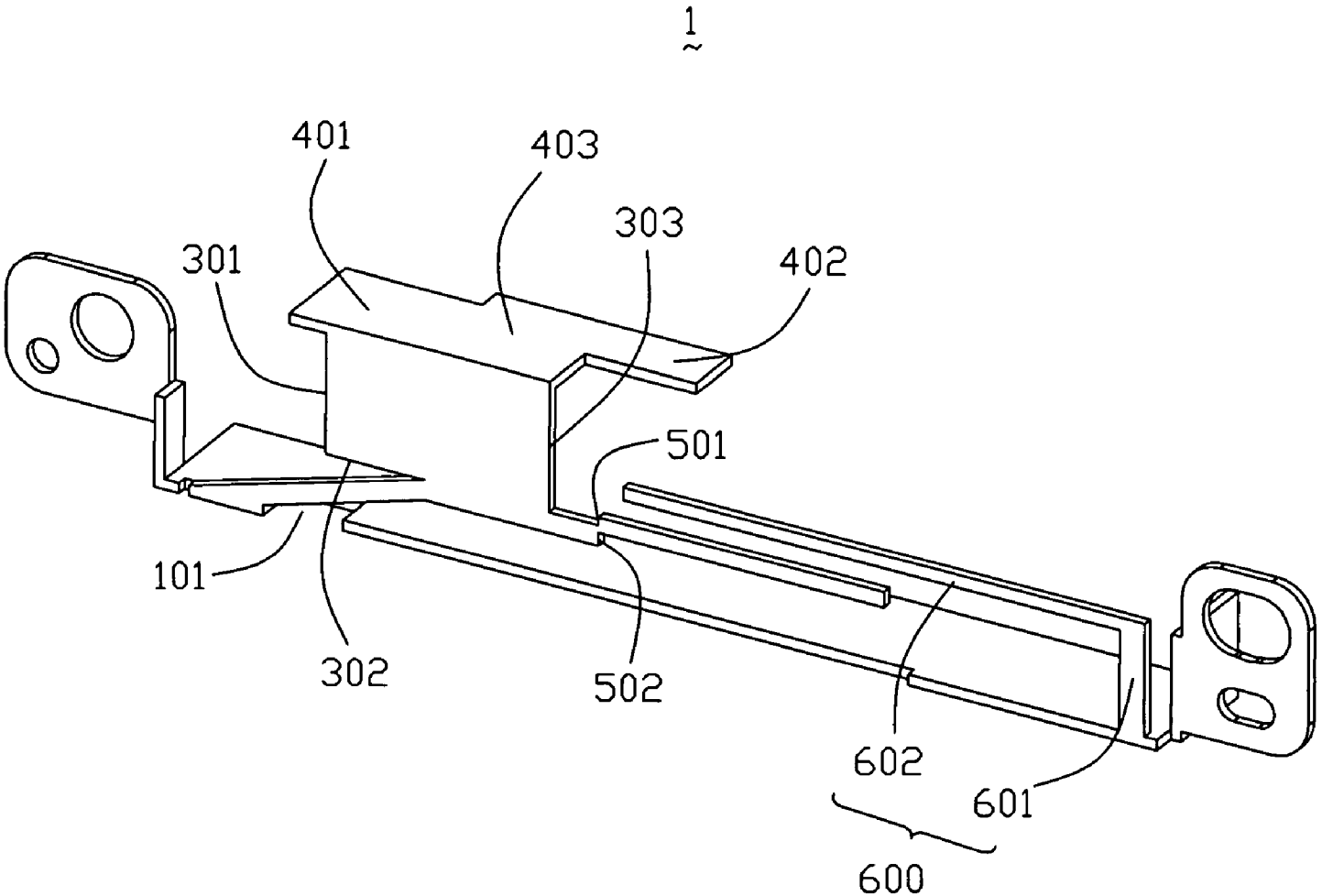
FIG. 2 is a perspective view of FIG. 1, but viewed from another angle.

Reference to FIG. 1 and FIG. 2, a multi-band antenna in according with a first embodiment of the present invention is shown. The multi-band antenna 1 is used in a notebook (not shown), and made from a integrated metal patch by incising and bending methods. The multi-band antenna 1 comprises a grounding element 100, a connecting element 200, a first conductive portion 300 extending from the connecting element 200, a second conductive portion 400 extending from the top of the first conductive portion 300, a first coupling portion 500 extending from the end of the connecting element 200, a second coupling portion 600 and a pair of setting portions 700, 800. The grounding element 100 is located on a first plane and comprises a first side. The connecting element 200 extends from one end of the first side of the grounding element 10120 and the second coupling portion 600 extends from the other end of the first side of the grounding element 100. All of the connecting element 200, the first conductive portion 300, the first coupling portion 500 and the second coupling portion 600 is located on the second plane which is perpendicular to the first plane. The second conductive portion 400 is located on a third plane which is perpendicular to the second plane and parallel to the first plane.

The grounding element 100 is on the bottom of the multi-band antenna 1. The setting portions 700, 800 respectively extend from the two opposite ends of the grounding element 100 to fix the multi-band antenna 1 on the notebook.

The connecting element 200 comprises a first connecting portion 201 aslant extending from the grounding element 100 to form an angle therebetween and a second connecting portion 202 extending from the end of the first connecting portion 201 along a first horizontal direction. A triangle slot is formed between the first connecting portion 201 and the grounding element 100. A feeding point F is formed on the end of the second connecting portion 202. The grounding element 100 also comprises a gap 101, which the joint of the grounding element 100 and the first connecting portion 201 is connected to, for engineering need.

The first conductive portion 300 is of rectangular configuration and upward extends from the second connecting portion 202. The first conductive portion 300 comprises a vertical first side 301, a vertical second side 303 separated from and parallel to the first side 301, and a bottom side 302. The bottom side 302 comprises a section which disconnects to the second connecting portion 202 so that a triangle slot is formed between the second side 302 and the second connecting portion 202.

The second conductive portion 400 is of Z-shape configuration and comprises a first section 401 extending along a second horizontal direction, a second section 402 extending along a first horizontal direction, and a third section 403 connecting the first section 401 and the second section 402. The first section 401 is beyond the first side 301 to form a free end. The second section 402 is beyond the second side 303 to form a free end. The conductive portion 300 is wider than the second conductive portion 400 to increase the band width of the multi-band antenna 1. The conductive portion 300 and the second conductive portion 400 are used to receive and send a frequency band on 3.1-4.8 GHz.

The first coupling portion 500 extends from the end of the second connecting portion 202 along the first horizontal direction to form a step therebetween.

Figure 3:
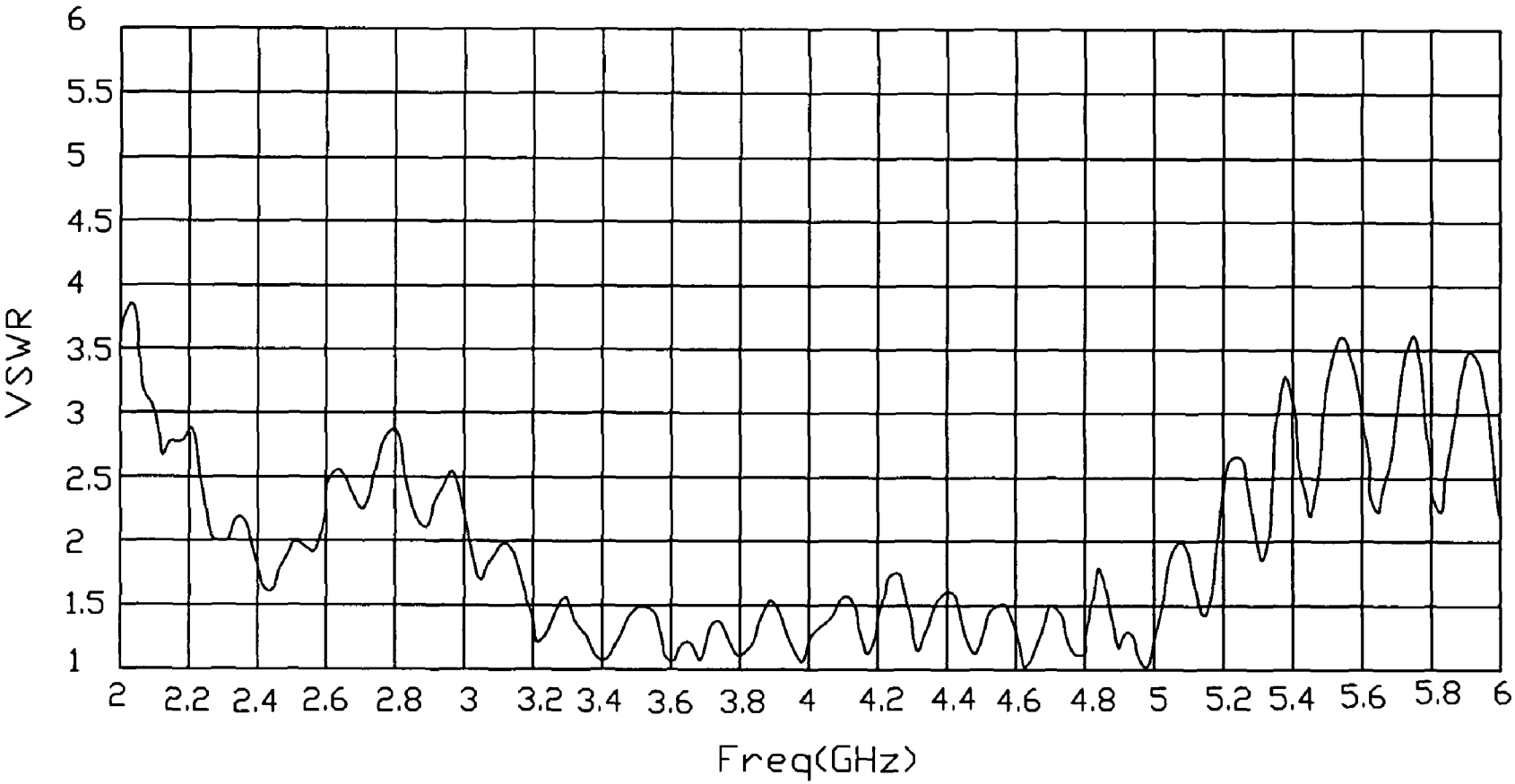
FIG. 3 is a test chart recording for the multi-band antenna of FIG. 1, showing Voltage Standing Wave Ratio (VSWR) as a function of WLAN frequency.

The second coupling portion 600 is of L-shape configuration. The second coupling portion 600 comprises a first arm 601 connected to the grounding element 100 and a second arm 602 extending from the first arm 601 in a direction perpendicular to the first arm 601. The second arm 602 extends along the first perpendicular direction and the end of the second arm 602 is overlap the first coupling portion 500. The second section 402 is higher than the two coupling portion 500, 600 but not overlap the two coupling portion 500, 600. The first and second coupling portion 500, 600 are used on a frequency band on 2.5 GHz. Reference to FIG. 3, the test chart of the multi-band antenna 1 shows the multi-band antenna 1 working at 2.5 GHz and 3.1-4.8 GHz.

What is claimed is:

1. A multi-band antenna, comprising:

a grounding element;

a connecting element, extending from one end of the grounding element;

a first conductive portion, extending from the connecting element;

a second conductive portion, extending from the first conductive portion and narrower than the first conductive portion;

a first coupling portion, extending from the connecting element in a first direction;

a second coupling portion, extending from the other end of the grounding element;

said second coupling portion extending in a second direction opposite to the first direction and overlap the first coupling portion.

2. The multi-band antenna as claimed in claim 1, wherein said connecting element comprises a first connecting portion extending from the grounding element to form an angle therebetween and a second connecting portion extending from the first connecting portion along said first direction.

3. The multi-band antenna as claimed in claim 2, wherein said connecting element defines a feeding point on the end of the second connecting portion.

4. The multi-band antenna as claimed in claim 2, wherein said first conductive portion is of rectangular configuration and upward extends from the second connecting portion.

5. The multi-band antenna as claimed in claim 2, wherein said first conductive portion comprises a bottom side having a section which disconnects to the second connecting portion.

6. The multi-band antenna as claimed in claim 2, wherein said first coupling portion extends from the end of the second connecting portion along the first direction to form a step therebetween.

7. The multi-band antenna as claimed in claim 1, wherein said second conductive portion is of Z-shape configuration.

8. The multi-band antenna as claimed in claim 1, wherein said second conductive portion comprises a first section extending along the second direction, a second section extending along the first direction, and a third section connecting the first section and the second section.

9. The multi-band antenna as claimed in claim 8, wherein said first section is beyond the first side to form a free end, said second section is beyond the second side to form a free end.

10. The multi-band antenna as claimed in claim 8, wherein said second section is higher than the two coupling portion but not overlap the two coupling portion.

11. The multi-band antenna as claimed in claim 1, wherein said second coupling portion is of L-shape configuration.

12. The multi-band antenna as claimed in claim 1, wherein said second coupling portion comprises a first arm connected to the grounding element and a second arm extending from the first arm in a direction perpendicular to the first arm.

13. A multi-band antenna comprising:

a grounding element;

a narrow connection element having an oblique segment extending from the grounding element and a horizontal segment successively extending from a distal end of said oblique segment;

a first conductive portion essentially extending coplanar with said connection element in a vertical plane and defining a bottom edge cooperating with the oblique segment to commonly define a wedged gap therebetween while cooperating with the horizontal segment to commonly define a right angle cutout thereabouts.

14. The multi-band antenna as claimed in claim 13, further including a first coupling portion extending in a first horizontal direction from a distal end of the horizontal segment in said vertical plane while in an offset manner.

15. The multi-band antenna as claimed in claim 13, further including a second conductive portion extending from a top edge of the first conductive portion in another plane different from said vertical plane.

16. The multi-band antenna as claimed in claim 13, further including a second conductive portion extending from a top edge of the first conductive portion, wherein said second conductive portion defines a Z like configuration in a top view.

17. The multi-band antenna as claimed in claim 13, further including a lying L-shaped coupling portion extending from a distal end of the grounding element toward the first conductive portion.

* * * * *